US006637339B1

(12) United States Patent
Petzold et al.

(10) Patent No.: US 6,637,339 B1
(45) Date of Patent: Oct. 28, 2003

(54) METHOD FOR EXCHANGING DATA BETWEEN A DEVICE FOR PROGRAMMING AND TRIGGERING ELECTRONIC DETONATORS AND SAID DETONATORS

(75) Inventors: Jan Petzold, Rösrath (DE); Heinz Schäfer, Lilienthal (DE); Ulrich Steiner, Troisdorf (DE); Andreas Zemla, Troisdorf (DE)

(73) Assignee: Dynamit Nobel GmbH Explosivstoff und Systemtechnik, Troisdorf (DE)

( * ) Notice: Subject to any disclaimer, the term of this patent is extended or adjusted under 35 U.S.C. 154(b) by 0 days.

(21) Appl. No.: 09/936,936

(22) PCT Filed: Mar. 2, 2000

(86) PCT No.: PCT/EP00/01820

§ 371 (c)(1),
(2), (4) Date: Jan. 23, 2002

(87) PCT Pub. No.: WO00/57125

PCT Pub. Date: Sep. 28, 2000

(30) Foreign Application Priority Data

Mar. 20, 1999 (DE) ..... 199 12 688

(51) Int. Cl.[7] ..... F42C 11/00; F23Q 7/02; F23Q 21/00

(52) U.S. Cl. ..... 102/217; 102/200; 102/218

(58) Field of Search ..... 102/200, 217, 102/218

(56) References Cited

U.S. PATENT DOCUMENTS 4,576,093 A * 3/1986 Snyder ..... 102/200
4,674,047 A * 6/1987 Tyler et al. ..... 364/423
4,777,880 A * 10/1988 Beattie et al. ..... 102/312
4,884,506 A * 12/1989 Guerreri ..... 102/200
5,069,129 A * 12/1991 Kunitomo ..... 102/200
5,090,321 A * 2/1992 Abouav ..... 102/200
5,295,438 A * 3/1994 Hill et al. ..... 102/217
5,517,920 A * 5/1996 Hinz et al. ..... 102/215
5,533,454 A * 7/1996 Ellis et al. ..... 102/202.1
5,721,493 A * 2/1998 Paxton ..... 324/502
6,000,338 A * 12/1999 Shann ..... 102/217
6,148,263 A * 11/2000 Brooks et al. ..... 702/6

FOREIGN PATENT DOCUMENTS

DE 2 049 065 * 5/1971
DE 3441413 7/1985
EP 0 434 883 A1 * 7/1991 ..... F42C/11/06
EP 0588685 3/1994
FR 2 424 511 * 11/1979 ..... F42D/1/06
GB 922193 * 3/1963

* cited by examiner

*Primary Examiner*—Michael J. Carone
*Assistant Examiner*—H. A. Blackner
(74) *Attorney, Agent, or Firm*—Antonelli, Terry, Stout, & Kraus, LLP

(57) ABSTRACT

Effects of capacitive resistances on the transmission of data between electronic igniters of an ignition system and a device for programming and triggering igniters are avoided by the disclosed method. Prior to a planned communication of an igniter with the device, a dc voltage is applied to the ignition circuit for a predetermined length of time. This voltage is higher than the voltage provided for generating the signals with which the data are generated. Subsequently, the signals that the igniter transmits in response are produced with a lower voltage than the previously elevated voltage and the dc voltage is increased once again prior to the response to an additional igniter.

5 Claims, 1 Drawing Sheet

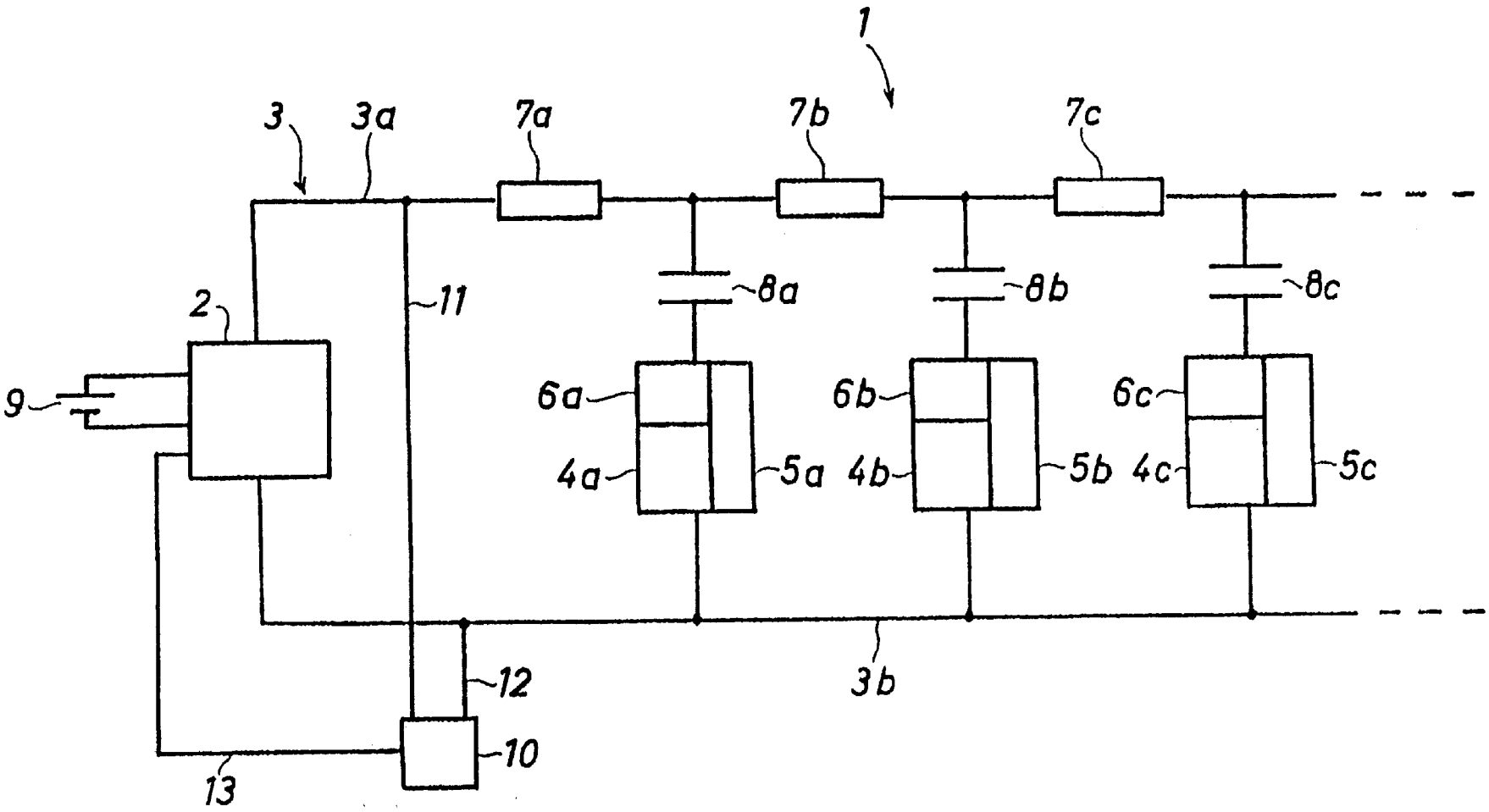
1
7a
7b
7c
8a
8b
8c
5a
5b
5c
6a
6b
6c
4a
4b
4c
3a
3b
3
2
9
11
12
10
13

METHOD FOR EXCHANGING DATA BETWEEN A DEVICE FOR PROGRAMMING AND TRIGGERING ELECTRONIC DETONATORS AND SAID DETONATORS

BACKGROUND OF THE INVENTION

The invention relates to a method for exchanging data between a device for programming and triggering electronic detonators and the detonators, wherein a plurality electronic detonators are disposed one behind the other in an ignition circuit, an address is assigned to each of the electronic detonators, the detonators are triggered in a specifiable delay sequence and data are generated by a time sequence of signals having a specified voltage.

In the extraction of raw materials deposited in the earth, it is necessary to clear away rock masses preventing access to the raw materials and then to obtain the raw materials from their deposits by crushing. During this excavation method, explosions are carried out in which explosive charges disposed in many boreholes are detonated consecutively in accordance with a certain time schedule.

A method of controlling explosion detonators and a so-called coded structure for controlling the blasting are disclosed, for example, in EP 0 588 685 B1. The electronic detonators of the explosive charges form an ignition system. The electronic detonators are commonly connected to a programming and triggering device via a so-called bus line. Via said bus line, the electronic detonators are activated and receive electrical energy that is capacitively stored by them. If the capacitance of a detonator is charged, it is capable of independently remaining in operation with the aid of the energy stored in its capacitor. The stored energy safeguards the ignition function and also the communication function between the detonator and the programming and triggering device of the detonators.

As a rule, every individual detonator has an address that is assigned to it and comprises a multidigit digital code. The delay time that determines the instant at which the respective detonator is detonated is transmitted in the form of coded signals to every individual detonator. The signals may consist of a polarity change of a specified voltage having a specified amplitude. The delay time is coupled to an address code so that every detonator charges only for the delay time assigned to it on the basis of the address code. After the detonator has received the transmitted data assigned to it, it has to respond so that it is possible to confirm that the delay time has been received and stored correctly by the electronics of the detonator.

During the communication of a detonator with the programming and triggering device of the detonator, problems occur in that the other detonators connected to the bus line are capacitive resistances that affect the transmission of the data. The data signals comprise, as a rule, a polarity change in a certain time sequence and in a certain number. These polarity changes are distorted by the capacitive resistances so that a clear transmission of the signals is not always guaranteed. Taking into account the capacitive resistances, the data transmission rates per unit time are low and the programming of a detonator, which takes place in the dialogue of the electronics of the detonator with the programming and triggering device of the detonators, is time-consuming and not always fault-free.

SUMMARY OF THE INVENTION

The object of the present invention is therefore to make the exchange of data between an electronic detonator programming and triggering device and the detonators more reliable and more rapid.

According to the invention, prior to an intended communication of an electronic detonator with the detonator programming and triggering device, there is applied to the ignition circuit for a specified time a direct voltage that is greater than the voltage of the signals with which the data are generated that the detonator transmits as a response. The increased voltage is below a critical voltage for triggering a detonator. As a rule, the detonators are designed in such a way that they are resistant, i.e., are not triggered, to a voltage that is at a certain height above the nominal voltage provided for generating the signals for communicating with the detonators. According to the invention, the tolerance range provided is, however, not exhausted in order to avoid any risk. On the other hand, the amplitude of the voltage is chosen in such a way that the capacitances of the other detonators are charged within a very short time to such a level as to avoid an attenuation of the voltage with which the detonator response signals are generated.

To transmit the detonator response, the voltage is reduced and the signals of the data that the detonator transmits as a response are generated at a lower voltage. During the transmission of the signals of the responding detonator, all the other detonators are charged to such a high level that they are no longer capacitive resistances and communication is thereby possible at a very high data transmission rate per unit time. The voltage in the ignition circuit is increased during such a time a such a value that, during the subsequent detonator response, capacitances of the other detonators do not have to be charged as a result of charge losses.

The magnitude of the capacitive and ohmic resistances within the ignition circuit depends on the number of connected electronic detonators. In a further advantageous refinement of the invention, it is possible that the capacitive resistance is ascertained and the minimum direct voltage necessary to charge the capacitances is determined as a function of its magnitude. In addition, the voltage drop due to the ohmic resistances can be compensated for. The increase in the direct voltage can consequently be matched individually to the particular application case. In addition, this ensures that the voltage does not exceed a critical value that results in the triggering of a detonator.

BRIEF DESCRIPTION OF THE DRAWING FIGURE

The invention is explained in greater detail by reference to the sole FIGURE in the application, the sole FIGURE being a replacement circuit diagram.

DETAILED DESCRIPTION OF THE PREFERRED EMBODIMENTS

The replacement circuit diagram of an ignition circuit is detonated by 1. A bus line 3, represented by two line conductors 3*a* and 3*b*, is routed from the detonator programming and triggering device 2 to the detonators 4*a*, 4*b* and 4*c*. Assigned to the detonators 4*a*, 4*b* and 4*c* are the respective charges 5*a*, 5*b* and 5*c* to be ignited. The three electronic detonators shown represent any desired number of detonators that are connected to the bus line 3 to fulfil the respective requirement. Said bus line 3 makes possible a bidirectional data transmission, that is to say from the detonator programming and triggering device 2 to the detonators and back from the detonator electronics to the device 2.

The length of the bus line 3 and the detonator electronics cause a voltage drop within the ignition circuit 1 and this is represented by the ohmic resistances detonated by 7*a,* 7*b* and 7*c*. Capacitors that are intended to represent the energy stores of the respective detonators are detonated by 8*a,* 8*b* and 8*c*. The energy stored in them makes possible communication between the detonators 4*a* to 4*c* and the detonator programming and triggering device 2. In addition, the stored energy serves to trigger the detonators.

To ensure the ignition of the individual detonators 4*a* to 4*c* and the detonators not shown in further detail here in addition in the planned sequence at the planned instants, it is necessary for every detonator to receive a communicated delay time assigned to it. Each of the detonators 4*a* to 4*c* has an address stored in its electronic circuit 6*a* to 6*c*. Said address comprises a coded signal, a signal containing a specified number of polarity changes in a specified time. The data are transmitted by a voltage having a certain amplitude that is supplied by the voltage source 9.

In order to ensure the transmission of the data, the respectively addressed detonator responds when it has received the data correctly with the delay time provided for it. To overcome the capacitive resistance, the voltage of the voltage source 9 is increased prior to the detonator's response for a specified time to such an extent that the capacitances of the other detonators are charged to such an extent that, at the instant when the detonator responds, no capacitances of the other detonators have to be charged as a result of charge losses in the capacitances. Consequently, the other detonators do not represent for the responding detonator capacitive resistors that impair the quality of the response signals.

The response of the responding detonator takes place at a lower voltage level than the previously increased voltage level. For the reasons mentioned above, a fault-free transmission of the signals of the detonator takes place to the detonator programming and triggering device 2. Once the responding detonator has transmitted its response and a subsequent detonator is to respond, the voltage is also increased in the ignition circuit prior to its response so that the signal transmission is not impeded by capacitive resistances during the subsequent response.

Prior to switching to a higher voltage, it is possible that, in accordance with the present exemplifying embodiment, the capacitive resistance and the voltage drop in the ignition circuit 1 are ascertained by means of a test device that is detonated by 10 and is connected via the lines 11 and 12 to the line conductors 3*a* and 3*b,* respectively, of the bus line 3. These values are transmitted via the line 13 to the detonator programming and triggering device 2. The overcome the capacitive resistance and to charge the capacitances, a higher voltage is then applied to the ignition circuit 1 for a specified time than is necessary to generate the data signals that the detonator transmits as a response.

As a result of the fact that the effect of the capacitive resistances in the ignition circuit 1 is eliminated prior to every response of a detonator, a fault-free communication is possible between the detonator programming and triggering device 2 and the detonators 4*a* to 4*c* at a high signal transmission rate.

What is claimed is:

1. Method for exchanging data between electronic detonators and a detonator programming and triggering device, wherein a plurality of electronic detonators are disposed one behind the other in an ignition circuit, and address is assigned to each of the electronic detonators, the detonators are triggered in a specifiable delay sequence and data are generated by a time sequence of signals having a specified voltage, characterized in that, prior to an intended communication of an electronic detonator with the detonator programmable and triggering device, there is applied to the ignition circuit for a specified time a direct voltage that is higher than the voltage provided for signal generation, in that the signals with which the data are generated that the electronic detonator transmits as a response are then generated at a lower voltage than the previously increased direct voltage, and in that, prior to the response of a further electronic detonator, the direct voltage is increased again.

2. Method according to claim 1, characterized in that the direct voltage in the ignition circuit is increased for such a time to such a value that, during the subsequent response of an electronic detonator, no capacitances of the other electronic detonators is being charged as a result of charge losses.

3. Method according to claim 1, characterized in that the increased voltage is below a critical voltage for triggering an electronic detonator.

4. Method according to claim 1, characterized in that a capacitive resistance in the ignition circuit is ascertained and the direct voltage at least necessary for a capacitance is determined as a function of its magnitude.

5. Method according to claim 1, characterized in that a voltage drop due to ohmic resistance in the ignition circuit is ascertained and a voltage is determined that is necessary to compensate for it.

* * * * *